US005961059A

United States Patent [19]

Kroger

[11] Patent Number: 5,961,059

[45] Date of Patent: Oct. 5, 1999

[54] SUPPORT FOR DRIVE SYSTEM IN A PAPER SHREDDER

[75] Inventor: Bruce R. Kroger, West Chicago, Ill.

[73] Assignee: Fellowes Manufacturing Company, Itasca, Ill.

[21] Appl. No.: 08/846,734

[22] Filed: Apr. 30, 1997

[51] Int. Cl.[6] ..... B02C 18/16

[52] U.S. Cl. ..... 241/236; 241/285.1

[58] Field of Search ..... 241/100, 236, 241/285.1, 285.2

[56] References Cited

U.S. PATENT DOCUMENTS

| | | | |
|---|---|---|---|
| 2,770,302 | 11/1956 | Lee . | |
| 3,033,064 | 5/1962 | Lee . | |
| 3,286,574 | 11/1966 | Durand . | |
| 3,724,766 | 4/1973 | Bosland | 241/100 |
| 3,797,765 | 3/1974 | Samuels | 241/236 |
| 3,991,944 | 11/1976 | Baikoff | 241/36 |
| 4,018,392 | 4/1977 | Wagner | 241/167 |
| 4,172,400 | 10/1979 | Brierley | 83/500 |
| 4,260,115 | 4/1981 | Hatanaka | 241/236 |
| 4,394,983 | 7/1983 | Ulsky | 241/243 |
| 4,489,897 | 12/1984 | Turner et al. | 241/167 |
| 4,562,971 | 1/1986 | Schwelling | 241/236 |
| 4,565,330 | 1/1986 | Katoh | 241/236 |
| 4,657,192 | 4/1987 | Browning | 241/224 |
| 4,688,730 | 8/1987 | Dahle | 241/166 |
| 4,690,340 | 9/1987 | Hatanaka | 241/236 |
| 4,691,871 | 9/1987 | Mochizuki | 241/166 |
| 4,693,428 | 9/1987 | Raterman et al. | 241/167 |
| 4,772,765 | 9/1988 | Markle et al. | 200/1 |
| 4,869,435 | 9/1989 | Pistorius et al. | 241/100 |
| 4,919,345 | 4/1990 | Burlington et al. | 241/36 |
| 4,997,134 | 3/1991 | MacGregor | 241/3 |
| 5,054,695 | 10/1991 | Koornhof | 241/30 |
| 5,071,080 | 12/1991 | Herbst et al. | 241/166 |
| 5,230,477 | 7/1993 | Strohmeyer | 241/166 |
| 5,295,633 | 3/1994 | Kimbro et al. | 241/166 |
| 5,328,107 | 7/1994 | Tsai | 241/295 |
| 5,346,144 | 9/1994 | Stangenberg | 241/100 |
| 5,400,978 | 3/1995 | Strohmeyer | 241/166 |
| 5,409,171 | 4/1995 | Stangenberg et al. | 241/167 |
| 5,511,732 | 4/1996 | Kroger et al. | 241/166 |

FOREIGN PATENT DOCUMENTS

| | | |
|---|---|---|
| 0 395 935 A2 | 11/1990 | European Pat. Off. . |
| 3 312 173 | 10/1984 | Germany . |
| 2 097 717 | 11/1982 | United Kingdom . |

OTHER PUBLICATIONS

Bulletin No. 10822–1, ⅜" *2–Speed Rev. Cordless Drill* The Black & Decker Corporation, Jul. 1988.

*Primary Examiner*—John M. Husar
*Attorney, Agent, or Firm*—Brinks Hofer Gilson & Lione

[57] ABSTRACT

A shredder having a housing with a first wall and a second wall spaced from the first wall, and a support with a first cradle extending from the first wall and a second cradle opposing the first cradle and extending from the second wall. The shredder also has a motor associated with and disposed between the first and second cradles. Also, the support may have a first cradled rib extending from the first wall and a second cradled rib opposing the first cradled rib and extending from the second wall. The shredder may also have a gear shaft with an end associated with and disposed between the first and second cradled ribs.

13 Claims, 3 Drawing Sheets

SUPPORT FOR DRIVE SYSTEM IN A PAPER SHREDDER

BACKGROUND OF THE INVENTION

This invention pertains to the field of shredders. More specifically, the invention relates to a support for a drive system in a paper shredder.

In order to destroy documents to preserve their confidentiality, shredders exist which cut the paper into narrow strips or chips. Typically, the cutting is achieved by a pair of cutting cylinders having a series of circular cutters arranged along the axis of a shaft. The cutters of one shaft are offset so that the cutters pass between the cutters of the other shaft. In addition, the cutters may be either a straight cut type, which produces narrow strips of paper, or a cross cut type, which produces small paper chips.

Generally, the cutting cylinders of a shredder are driven by a drive system that includes a motor and a series of gears and gear shafts. Typically, screws are used to hold the motor in the correct position and fasten it to the housing of the shredder. This results in extra parts, labor, cost, and time in assembling and manufacturing the shredder. In addition, a gear box or gear plate is normally used to hold the gears and gear shafts of the drive system in place. The use of a gear box or gear plate also requires extra parts, labor, cost, and time in assembling and manufacturing the shredder.

Accordingly, it is an object of the present invention to provide a shredder with a support for the drive system that does not require the extra parts, labor, cost, and time in assembling and manufacturing the shredder that are created by screwing the motor to the housing or by mounting the gears and gear shafts with a gear box or gear plate. In the present invention, a support for the motor is provided comprising at least one pair of opposing cradles that are integral with the housing. The present invention also provides a support for the gears and gear shafts that comprises at least one pair of opposing cradled ribs which are also integral with the housing. As a result of these supports for the drive system, the shredder of the present invention is an improvement over prior art shredders in that the shredder and drive system of the present invention are easily and quickly assembled with relatively little labor, low cost, and few parts.

SUMMARY OF THE INVENTION

The present invention provides a shredder comprising a housing having a first wall and a second wall spaced from the first wall, and a support having a first cradle extending from the first wall and a second cradle opposing the first cradle and extending from the second wall. The shredder also comprises a motor associated with and disposed between the first and second cradles.

The present invention also provides a shredder comprising a housing having a first wall and a second wall spaced from the first wall, and a support having a first cradled rib extending from the first wall and a second cradled rib opposing the first cradled rib and extending from the second wall. The shredder also comprises a gear shaft having an end associated with and disposed between the first and second cradled ribs.

DETAILED DESCRIPTION OF THE PREFERRED EMBODIMENTS

Figure 1:
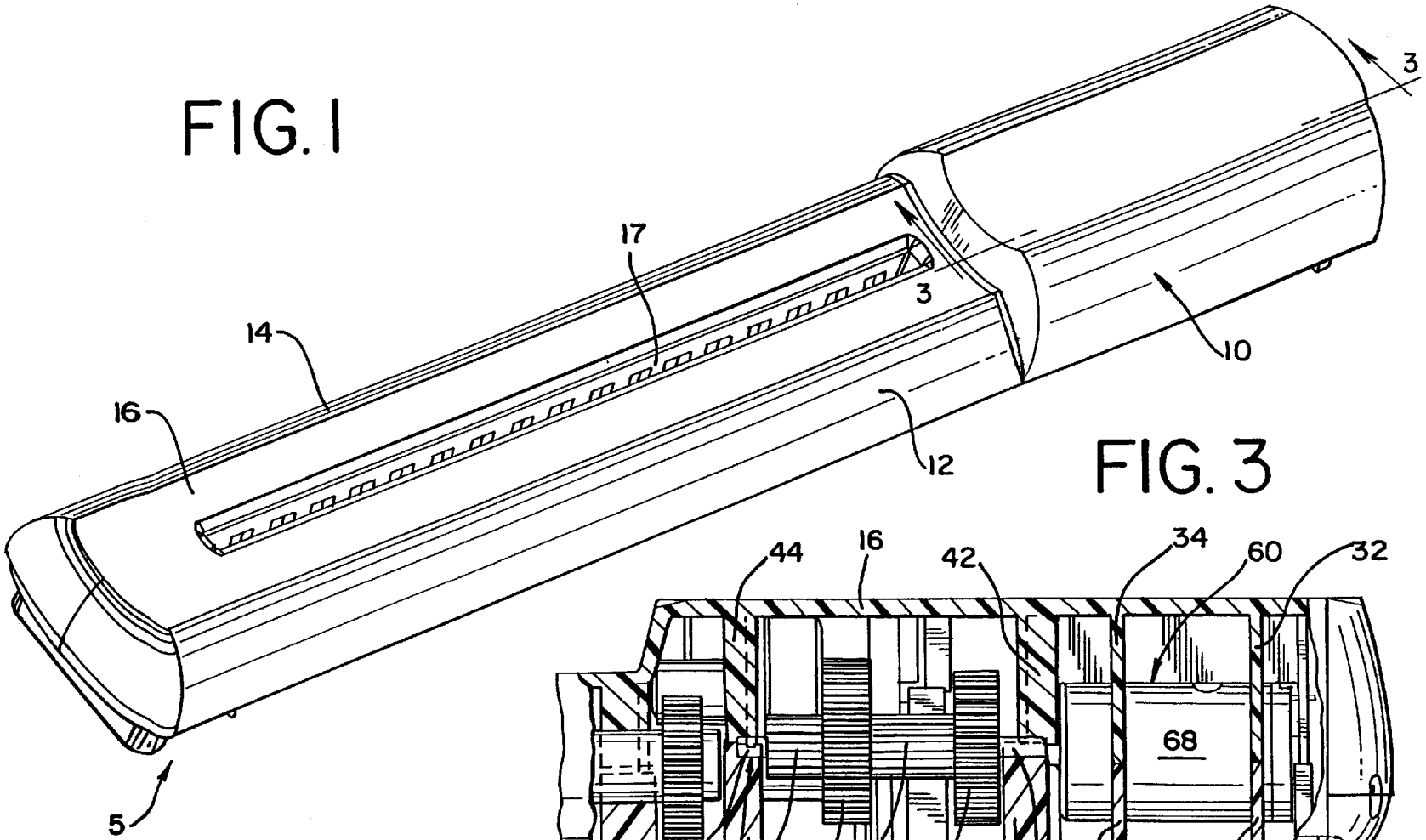
FIG. 1 is a perspective view of the shredder of the present invention.
Figure 2:
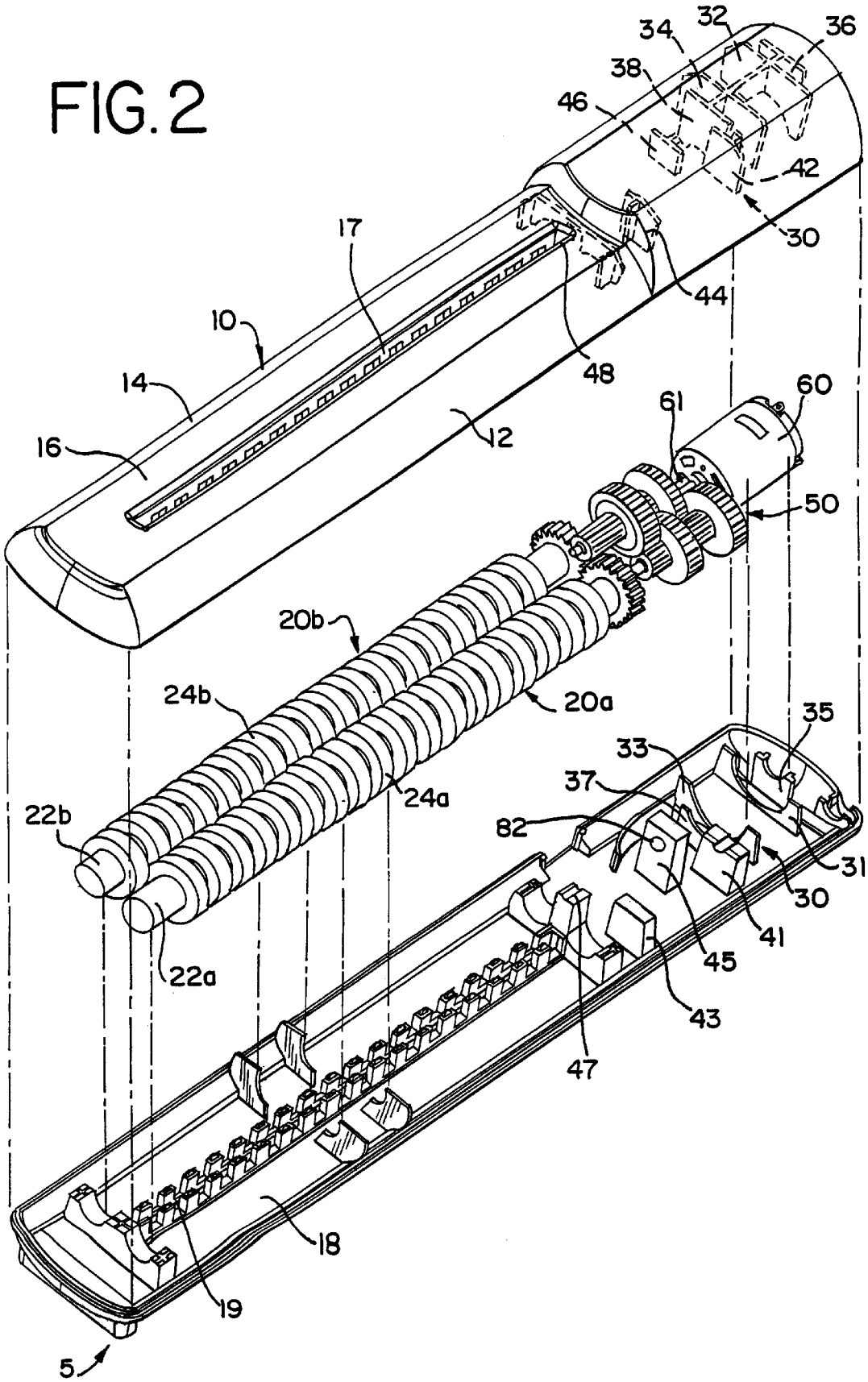
FIG. 2 is an exploded view of the shredder of FIG. 1 and the support of the present invention for the drive system of the shredder.

Turning now to the drawings, FIGS. 1–2 show a paper shredder 5 comprising a housing 10 with a first side wall 12, a second side wall 14, a top wall 16, and a bottom wall 18. The top wall 16 has a feed opening 17 through which the paper to be shredded is fed, and the bottom wall 18 has a discharge opening 19 through which the shredded paper exits.

As shown in FIG. 2, the paper shredder also comprises a pair of cutting cylinders 20*a*, 20*b*. In the particular embodiment shown in FIG. 2, each cutting cylinder 20*a*, 20*b* has a cutting shaft 22*a*, 22*b* and a plurality of spaced-apart cutter discs 24*a*, 24*b* arranged on the cutting shafts 22*a*, 22*b*, respectively. In particular, the cutter discs are sufficiently separated from each other to receive the cutter discs of the other cutting cylinder in an interleaving fashion. Although the cutter discs shown in FIG. 2 are of the straight cut type, it is to be understood that cutter discs of the cross cut type may also be used in the shredder of the present invention. An example of a paper shredder using cross cut type cutter discs is disclosed in U.S. Pat. No. 5,295,633, commonly assigned with the present application and specifically incorporated herein by reference.

Figure 3:
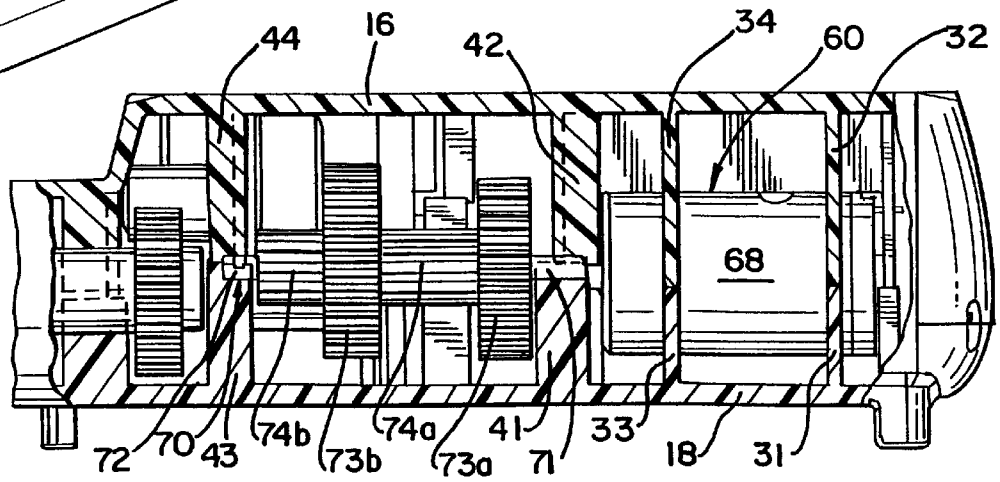
FIG. 3 is a cross-sectional view of the cutting cylinder of FIG. 1 taken along line 3—3.
Figure 4:
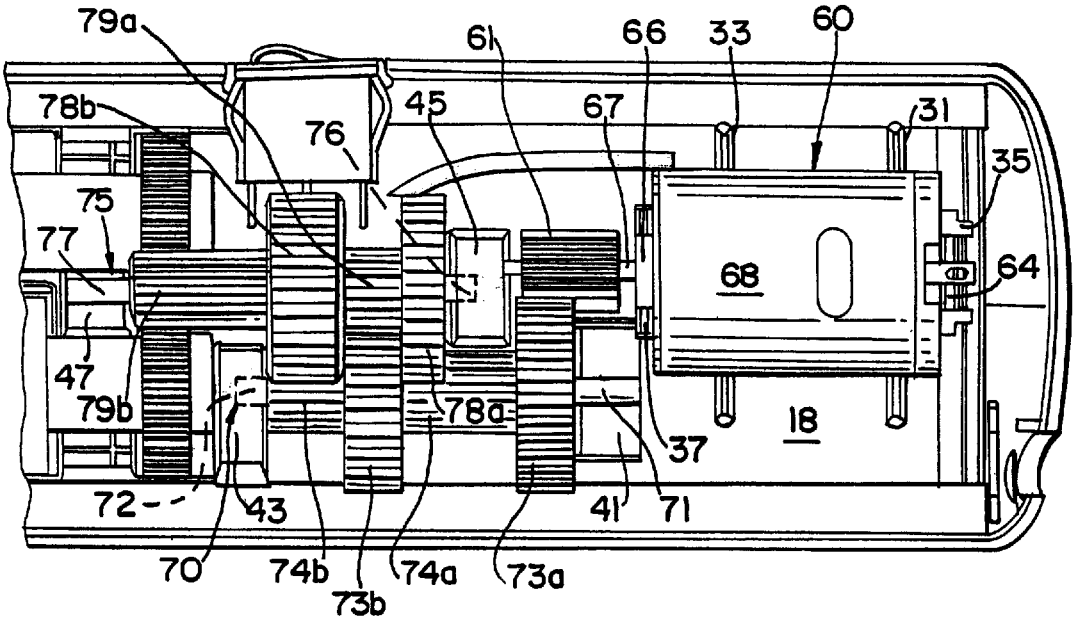
FIG. 4 is a partial top view of the bottom of the shredder of FIG. 1 and the support of FIG. 2, with the drive system of the shredder shown.

As shown in FIGS. 2–4, the paper shredder has a drive system 50 that comprises a motor 60 and at least one gear mounted on at least one gear shaft. The motor 60 has a drive gear 61 mounted on a drive shaft 62. Preferably, the motor 60 also has a first collar 64 on one end of the motor, a second collar 66 at the other end of the motor, and a body 68 between the first and second collars, as best shown in FIG. 4. Although the drive system may have any number of gears and gear shafts, the drive system 50 preferably has a first gear shaft 70 with a first end 71, a second end 72 spaced from the first end, and four gears 73*a*, 73*b*, 74*a*, 74*b*, and a second gear shaft 75 with a first end 76, a second end 77 spaced from the first end, and four gears 78*a*, 78*b*, 79*a*, 79*b*. Preferably, all of the gears are free to rotate about their respective gear shafts.

The paper shredder 5 also comprises a support 30 integral with the housing 10 for the drive system 50, as best shown in FIG. 3. The support comprises at least one pair of cradles for supporting the motor and/or at least one pair of cradled ribs for supporting a gear shaft. Preferably, but not necessarily, the support 30 comprises a first cradle 31 extending from and integral with the bottom wall 18 of the housing 10, a second cradle 32 opposing the first cradle and extending from and integral with the top wall 16 of the housing, a third cradle 33 extending from and integral with the bottom wall 18 of the housing 10, and a fourth cradle 34 opposing the third cradle and extending from and integral with the top wall 16 of the housing. The first and second cradles and the third and fourth cradles, respectively, support and hold the body of the motor in a fixed position between each pair of opposing cradles. The support 30 also preferably, but not necessarily, comprises a fifth cradle 35 extending from and integral with the bottom wall 18 of the housing 10, a sixth cradle 36 opposing the fifth cradle and extending from and integral with the top wall 16 of the housing, a seventh cradle 37 extending from and integral with the bottom wall 18 of the housing 10, and an eighth cradle 38 opposing the seventh cradle and extending from and integral with the top wall 16 of the housing. The fifth and sixth cradles support and hold the first collar of the motor in a fixed position between them, and the seventh and eighth cradles support and hold the second collar of the motor in a fixed position between them. In addition, a rubber grommet (not shown) may be placed around each collar of the motor to provide a damper between the collars of the motor and their respective cradles. The grommets help reduce any excessive noise and/or vibration of the motor during operation of the shredder.

In the most preferred embodiment of the present invention, the support comprises only the fifth, sixth, seventh, and eighth cradles for supporting the collars of the motor. It is to be understood, however, that these cradles may be readily supplemented or replaced by the first, second, third, and fourth cradles.

Figure 5:
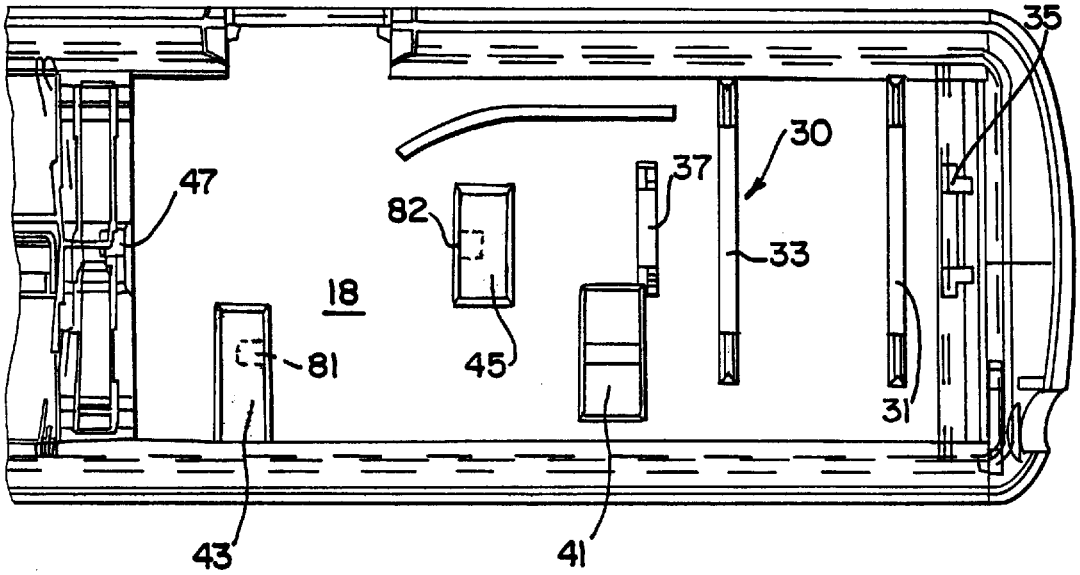
FIG. 5 is a partial top view of the bottom of the shredder of FIG. 1 and the support of FIG. 2, without the drive system of the shredder shown.

As shown in FIGS. 2–5, the support 30 also preferably, but not necessarily, comprises a first cradled rib 41 extending from and integral with the bottom wall 18 of the housing 10, a second cradled rib 42 opposing the first cradled rib and extending from and integral with the top wall 16 of the housing, a first support post 43 spaced from the first cradled rib and extending from and integral with the bottom wall 18 of the housing 10, and a second support post 44 opposing the first support post and extending from and integral with the top wall 16 of the housing. The first and second cradled ribs support and hold the first end 71 of the first gear shaft 70 in a fixed position between them. As best shown in FIG. 5, the first support post has an aperture 81 that is adapted to receive the second end 72 of the first gear shaft 70 and hold it in a fixed position.

Preferably, but not necessarily, the support 30 also comprises a third support post 45 extending from and integral with the bottom wall 18 of the housing 10, a fourth support post 46 opposing the third support post and extending from and integral with the top wall 16 of the housing, a third cradled rib 47 spaced from the third support post and extending from and integral with the bottom wall 18 of the housing 10, and a fourth cradled rib 48 opposing the third cradled rib and extending from and integral with the top wall 16 of the housing. As best shown in FIG. 5, the third support post has an aperture 82 that is adapted to receive the first end 76 of the second gear shaft 75 and hold it in a fixed position. The third and fourth cradled ribs support and hold the second end 77 of the second gear shaft 75 in a fixed position between them.

It is to be understood that either, or both, of the two pairs of opposing support posts 43, 44, 45, 46 may be readily replaced by a pair or pairs of opposing cradled ribs. The pair or pairs of opposing cradled ribs used to replace the support posts would preferably, but not necessarily, be a mirror image of the already present pairs of opposing cradled ribs 41, 42, 47, 48.

The support of the present invention functions in the following manner during the manufacture and operation of a shredder utilizing the support. In manufacturing the shredder, the motor is dropped into its respective cradles on the bottom wall of the housing. One end of each gear shaft is dropped into its respective cradled rib on the bottom wall of the housing, and the other end of each gear shaft is slid into the aperture of its respective support post on the bottom wall of the housing. Next, the cradles, cradled ribs, and support posts on the top wall of the housing are positioned directly opposite of the cradles, cradled ribs, and support posts, respectively, on the bottom wall. As a result, the components of the drive system, including the motor, gears and gear shafts, are supported and held in position between their respective pair of opposing cradles or cradled ribs, or in their respective support posts.

During operation of the shredder, the motor is supported and held in a fixed position between the opposing cradles. The motor is preferably held by its respective opposing cradles in a fixed vertical position, more preferably a fixed vertical and horizontal position, and most preferably a fixed vertical, horizontal, and rotational position. Similarly, one end of each gear shaft is supported and held in a fixed position between a pair of opposing cradled ribs, and the other end of each gear shaft is supported and held in a fixed position in a support post on the bottom wall. The ends of the gear shafts are preferably held by their respective opposing cradles or support posts in a fixed vertical position, more preferably a fixed vertical and horizontal position, and most preferably a fixed vertical, horizontal, and rotational position.

Preferably, but not necessarily, each cradle, cradled rib, and/or support post is in the same vertical plane as its respective opposing cradle, cradled rib, or support post. Although the cradles and/or cradled ribs need not be in contact with their respective opposing cradles or cradled ribs, they should be close enough to prevent substantial vertical, horizontal, and/or rotational movement of the motor and gear shafts supported and held between them. Alternatively, each pair of opposing cradles and/or cradled ribs, as well as each pair of opposing support posts, may be joined together by any desirable method such as welding, gluing, bonding, snap-fitting or the like.

The present invention can be used with particular advantage in a paper shredder for the office or the home. Since the support of the present invention is integral with the housing, no additional parts such as screws, plates, gear boxes, or the like are required. As a result, such paper shredders are relatively inexpensive. Also, because the support of the present invention is integral with the housing, the drive system of the shredder can be accurately positioned so that the motor and each gear and gear shaft of the drive system are in proper alignment and position with respect to the other components of the drive system and shredder. Accordingly, such paper shredders are also easy to properly manufacture.

It should be understood that a wide range of changes and modifications can be made to the embodiments of the support and paper shredder described above. For instance, the cradles, cradled ribs, and/or support posts of the support may be integral with and extend from any wall, or combination of walls, of the housing, and not just the walls specifically mentioned above. Also, the cradles, cradled ribs, and/or support posts may have any desirable number of different shapes and sizes without departing from the spirit of the invention. In addition, more or less cradles, cradled ribs, and/or support posts may be used for the support of the present invention depending on consumer and manufacturing preferences and the specific drive system used in the shredder. It is therefore intended that the foregoing description illustrates rather than limits this invention, and that it is the following claims, including all equivalents, which define this invention.

What is claimed is:

1. A shredder comprising:

a housing having a first wall and a second wall spaced from the first wall;

a gear shaft having a first end and a second end;

a support having a first cradled rib extending from the first wall, a second cradled rib opposing the first cradled rib and extending from the second wall, wherein the first end of the gear shaft is disposed between the first and second cradled ribs and a first support post spaced from the first cradled rib and extending from the first wall, the first support post having an aperture and the second end of the gear shaft is disposed in the aperture of the first support post.

2. The shredder of claim 1 wherein the support further comprises a second support post opposing the first support post and extending from the second wall, the second support post and the first support post being joined.

3. The shredder of claim 2 further comprising a second gear shaft having a first end and a second end, and wherein the support further comprises a second support post extending from the first wall and having an aperture, a third cradled rib spaced from the second support post and extending from the first wall, and a fourth cradled rib opposing the third cradled rib and extending from the second wall, the first end of the second gear shaft being disposed in the aperture of the second support post, and the second end of the second gear shaft being disposed between the third and fourth cradled ribs.

4. The shredder of claim 1 wherein the support further comprises a third cradled rib spaced from the first cradled rib and extending from the first wall, and a fourth cradled rib opposing the third cradled rib and extending from the second wall, the second end of the gear shaft being associated with and disposed between the third and fourth cradled ribs.

5. The shredder of claim 4 further comprising a second gear shaft having a first end and a second end, and wherein the support further comprises a fifth cradled rib extending from the first wall, a sixth cradled rib opposing the fifth cradled rib and extending from the second wall, a seventh cradled rib spaced from the fifth cradled rib and extending from the first wall, and an eighth cradled rib opposing the seventh cradled rib and extending from the second wall, the first end of the second gear shaft being disposed between the fifth and sixth cradled ribs, and the second end of the second gear shaft being disposed between the seventh and eighth cradled ribs.

6. The shredder of claim 1, wherein the support further comprises a first cradle extending from the first wall and a second cradle opposing the first cradle and extending from the second wall; and a motor associated with and disposed between the first and second cradles.

7. The shredder of claim 6, further comprising a third cradle extending from the first wall and a fourth cradle opposing the third cradle and extending from the second wall, the motor also being disposed between the third and fourth cradles.

8. The shredder of claim 7, further comprising a fifth cradle and a sixth cradle opposing the fifth cradle, the motor also being disposed between the fifth and sixth cradles.

9. The shredder of claim 8, further comprising a seventh cradle extending from the first wall and an eighth cradle opposing the seventh cradle and extending from the second wall, the motor also being disposed between the seventh and eighth cradles.

10. The shredder of claim 6 wherein the first and second cradles are joined.

11. The shredder of claim 7 wherein the first and second cradles are joined and the third and fourth cradles are joined.

12. The shredder of claim 8, wherein the first and second cradles are joined, the second and third cradles are joined, and the fifth and sixth cradles are joined.

13. The shredder of claim 9, wherein the first and second cradles are joined, the third and fourth cradles are joined, the fifth and sixth cradles are joined, and the seventh and eighth cradles are joined.

* * * * *